US005885166A

United States Patent [19]

Shiraishi

[11] Patent Number: 5,885,166

[45] Date of Patent: Mar. 23, 1999

[54] GOLF CLUB SET

[75] Inventor: Takayuki Shiraishi, Hiratsuka, Japan

[73] Assignee: The Yokohama Rubber Co., Ltd., Japan

[21] Appl. No.: 24,224

[22] Filed: Feb. 17, 1998

Related U.S. Application Data

[63] Continuation of Ser. No. 699,355, Aug. 19, 1996.

[30] Foreign Application Priority Data

Aug. 21, 1995 [JP] Japan ..... 7-212170
May 24, 1996 [JP] Japan ..... 8-130339

[51] Int. Cl.[6] ..... A63B 53/00

[52] U.S. Cl. ..... 473/291; 473/314; 473/349

[58] Field of Search ..... 473/287–291, 473/314, 349

[56] References Cited

U.S. PATENT DOCUMENTS 3,897,065 7/1975 Solheim ..... 473/349
4,128,242 12/1978 Elkins ..... 473/409
4,147,349 4/1979 Jeghers .
4,802,672 2/1989 Long .
4,874,171 10/1989 Ezaki ..... 473/290
5,228,688 7/1993 Davis .
5,316,297 5/1994 Chappell ..... 473/291
5,433,439 7/1995 Hsien .

FOREIGN PATENT DOCUMENTS 0 517 487 A 1 2/1992 European Pat. Off. .

*Primary Examiner*—Steven Wong
*Assistant Examiner*—Stephen L. Blau
*Attorney, Agent, or Firm*—Finnegan, Henderson, Farabow, Garrett & Dunner, L.L.P.

[57] ABSTRACT

This invention relates to a golf club set comprising at least seven iron type golf clubs of Nos. 3 to 9 the loft angle of which increases progressively within the range of $15° \leqq \theta \leqq 45°$ and the club length of which becomes progressively smaller with a greater club number. A centroid distance L (mm) as a vertical distance drawn from the center of gravity of each of the iron type golf clubs to a plane crossing orthogonally a plane, which in turn crosses orthogonally the club face of each of the iron type golf clubs, and including the center axis of a shaft of each of the iron type golf clubs is set by a predetermined formula in association with the loft angle.

4 Claims, 8 Drawing Sheets

GOLF CLUB SET

This is a continuation of application Ser. No. 08/699,355, filed on Aug. 19, 1996 which is incorporated herein by reference.

BACKGROUND OF THE INVENTION

This invention relates to a golf club set comprising at least Nos. 3 to 9 iron type golf clubs. More particularly, the present invention relates to a golf club set which can make the difference of flying distances between clubs of which club numbers are different by one number (one-number different clubs) substantially constant when a golfer swings each club in substantially the same way (with the same swing force).

Golf clubs can be broadly classified into wood type golf clubs, iron type golf clubs and a putter. Among them, the wood type golf clubs are the clubs for mainly obtaining a large flying distance. Therefore, the wood type golf clubs generally have the club numbers of 1 to 5 having a small loft angle which can secure more easily a greater yardage. On the other hand, the iron type golf clubs are the clubs for mainly obtaining a correct yardage. Therefore, they generally have the club numbers of 3 to 9, a pitching wedge (PW) and a sand wedge (SW) having a large loft angle which can more easily loft the ball and can reduce its run.

Among the iron type golf clubs for obtaining the correct flying distance, the clubs Nos. 3 to 9 are used in most cases for full swing to hit the ball, but the wedges such as the PW and the SW are used for control shot in most cases by adjusting the swing force because they are used so as to obtain more correctly a distance shorter than about 100 yards. For this reason, the flying distance depends on the skill of a golfer in the cases of the wedges but in the case of Nos. 3 to 9 irons, the flying distance is more likely to be governed by performance of the golf clubs themselves because these clubs are generally used in the full swing.

According to the iron type golf club set of the prior art, however, the difference of the flying distances between one-number different clubs is not always substantially constant when the golf clubs Nos. 3 to 9 are fully swung in the same way (at the same swing force), but have certain variance. Though this variance must be adjusted by controlling the swing force, such a control of the swing force is an extremely difficult technique for amateur golfers. In other words, there remains the problem that the flying distance becomes extremely unstable when different club number irons are used.

SUMMARY OF THE INVENTION:

In a golf club set comprising at least Nos. 3 to 9 iron type golf clubs, the object of the present invention is to provide a golf club set which can make the difference of the flying distance between one-number different clubs substantially constant provided that a golfer swing each golf club in the same way or with the same swing force.

The golf club set according to the present invention for accomplishing the object described above comprises at least seven iron type golf clubs Nos. 3 to 9, the loft angle of which becomes gradually greater within the range of $15° \leqq \theta \leqq 45°$ and the club length of which becomes gradually smaller with an increasing club number, wherein a centroid distance L (mm) as a distance drawn from the center of gravity G of the club head of each of the iron type golf clubs to a plane containing the central axis O—O of the club shaft and which is orthogonal to another plane (the plane of the paper in FIG. 2) that is orthogonal to the club head face, and satisfies the following formula (1) in association with the loft angle θ:

$$a\theta+b \leqq L \leqq a\theta+b+1 \quad \ldots (1)$$

where a is the inclination or slope of a linear plotting of values of L in millimeters as the ordinate and values of θ in degrees on the abscissa, and b is the value of L when θ=0, and where $-0.2 \leqq a \leqq 0.3$ and $a \neq 0$.

Another golf club set according to the present invention comprises at least seven iron golf clubs Nos. 3 to 9, the loft angle of which becomes gradually greater within the range of $15° \leqq \theta \leqq 45°$ and the club length of which becomes gradually smaller with an increasing club number, wherein a centroid distance L (mm) as a distance from the center of gravity G of the club head of each of the iron type golf clubs to a plane containing the central axis O—O of the club shaft and which is orthogonal to another plane ( the plane of the paper in FIG. 2) that is orthogonal to the club head face, and satisfies the following formula (2):

$$b \leqq L \leqq b+2 \quad \ldots (2)$$

In the present invention, the centroid distance L described above is proportional to the momentum at the time when the center of gravity G of the club head moves to the plane containing the center axis of the shaft due to flexibility of the club shaft caused by the centrifugal force as the club head of the golf club imparts impact to the golf ball. Therefore, in the golf club set comprising Nos. 3 to 9 iron type golf clubs, a momentum based on the movement of the center of gravity and applied to the ball, when each golf club is swung with the same swing force, can be kept in a predetermined proportional relation by keeping the centroid distance L within a predetermined range. Accordingly, the difference of the flying distance between one-number different clubs can be made substantially constant.

DETAILED DESCRIPTION OF THE PREFERRED EMBODIMENTS

Figure 1:
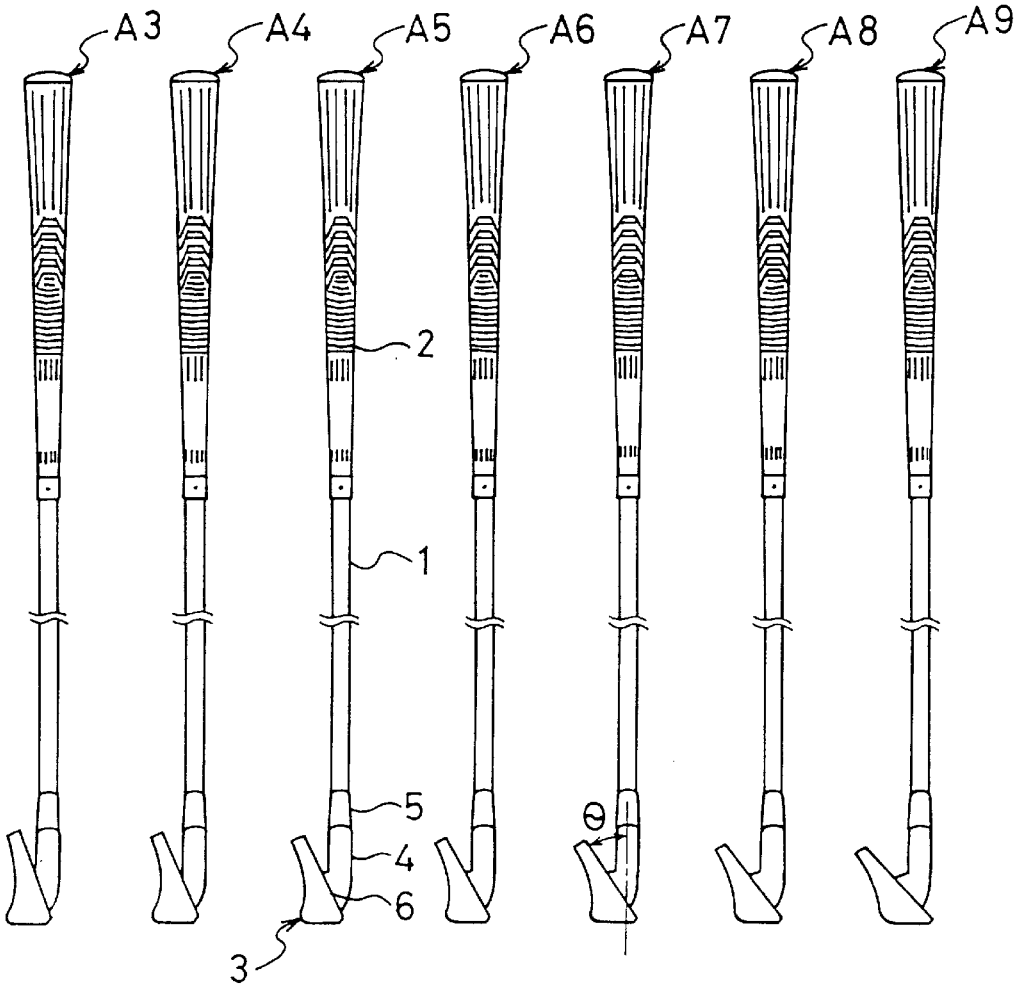
FIG. 1 is a side view showing each of seven iron type golf clubs Nos. 3 to 9 constituting a golf club set according to the present invention with a part thereof being omitted.

Seven iron type golf clubs constituting the golf club set according to the present invention continue from a No. 3 iron type golf club A3 to a No. 9 iron type golf club A9 as shown in FIG. 1. Each of these golf clubs has a grip 2 at one of the ends of a club shaft 1 thereof and a club head 3 at the other end of the club shaft 1. The club shaft 1 is interconnected to a hosel 4, which is so formed in the club head 3 on its heel side as to protrude upward, through a socket 5. In these iron type golf clubs A3 to A9, a loft angle θ of a planar face 6 formed on the front surface of the club head 3 with respect to the vertical becomes progressively greater at a substantially constant ratio within the range of $15° \leqq \theta \leqq 45°$ with an increasing club number. The length from the end portion of the grip 2 to the lower end of the club head 3 (that is, the club length) becomes progressively smaller with the increasing club number.

Figure 2:
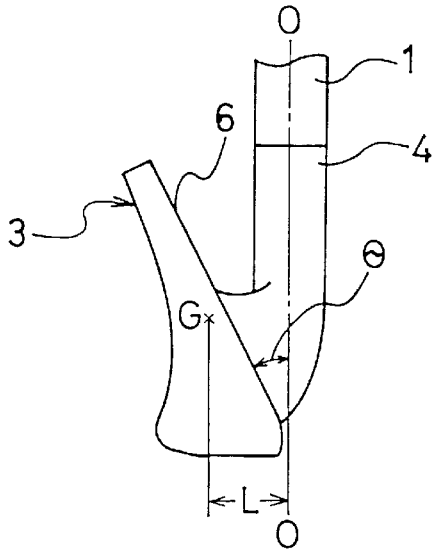
FIG. 2 is a side view showing principal portions of a club head portion of an example of an iron type golf club.
Figure 3:
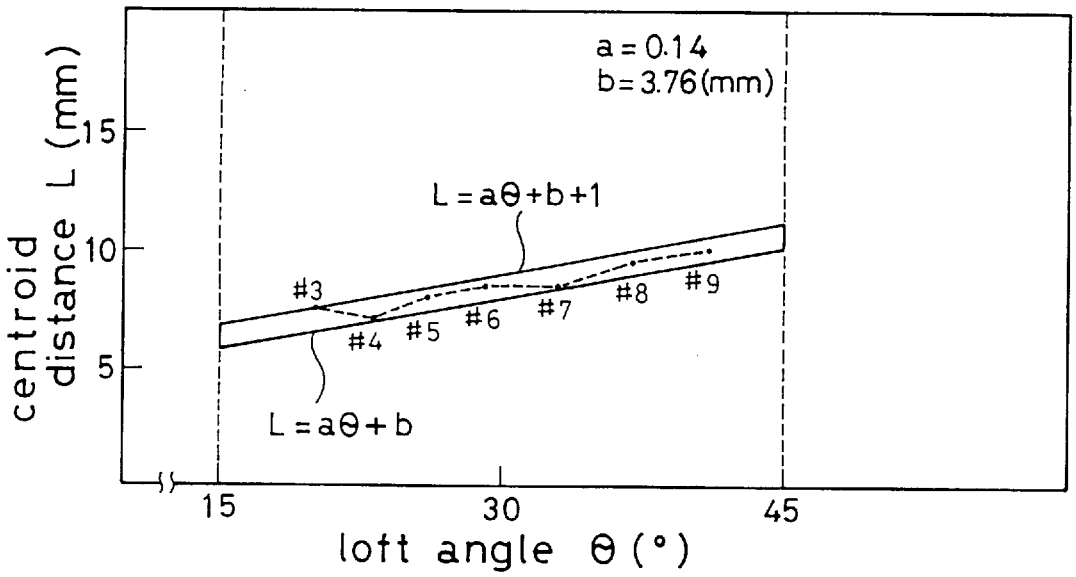
FIG. 3 is a graph showing the relation between a centroid distance L and a loft angle θ in the golf club set according to the present invention.
Figure 4:
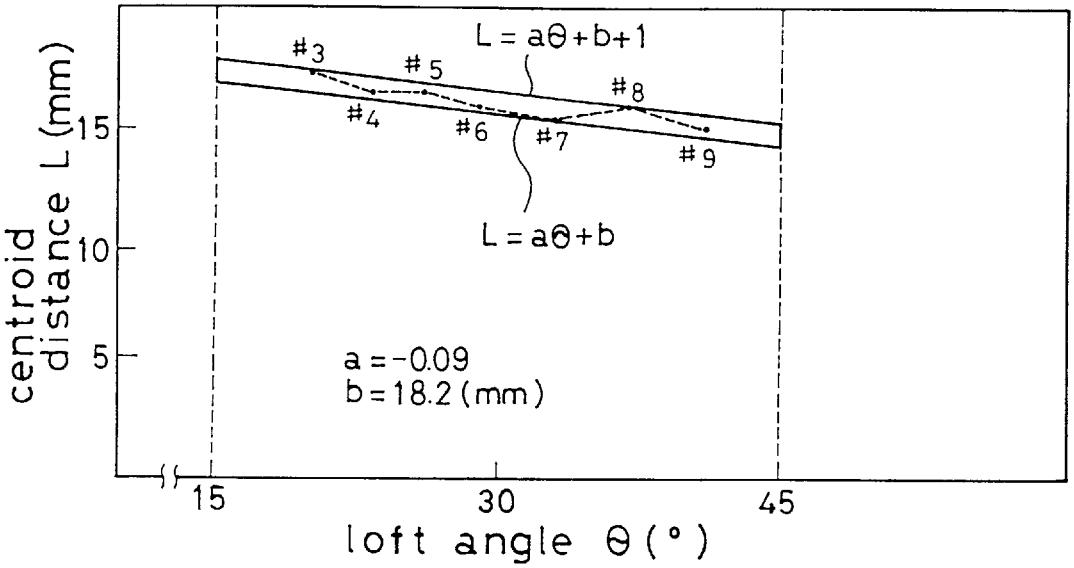
FIG. 4 is a graph showing the relation between the centroid distance L and the loft angle θ in another example of the golf club set according to the present invention.

The iron type golf clubs in the present invention have the following structure. Namely, the centroid distance L (mm) defined by the distance between the vertical line shown in FIG. 2 and drawn from the center of gravity G of the club head 3 to the plane, containing the central axis O—O of the club shaft and which is orthogonal to another plane ( the plane of the paper in FIG. 2) that is orthogonal to the club head face 6, always exists within the range of $a\theta+b \leqq L \leqq a\theta+b+1$ stipulated by the afore-mentioned formula (1) and typically shown in FIGS. 3 and 4, in conjunction with the loft angle θ described above. FIG. 3 shows the case where a is positive (+) and FIG. 4 shows the case where it is negative (−). The inclination a in the formula satisfies the relation $-0.2 \leqq a \leqq 0.3$ and $a \neq 0$.

The inventor of the present invention has conducted a series of studies on the fact that although the loft angle becomes progressively greater at a substantially constant ratio with the higher golf club number, the differences of the flying distances among the golf clubs having one-number different club numbers do not become substantially constant but exhibit certain variance even though each golf club is swung to hit a golf ball with the same swing force. As a result, the present inventor has realized that the momentum due to flexibility of the club shaft exerts great influences and that this momentum is closely associated with the centroid distance L from the center of gravity G of the golf club head to the plane containing the central axis O—O of the club shaft and which is orthogonal to another plane (the plane of the paper FIG. 2) that is orthogonal to the club head face.

Figure 17:
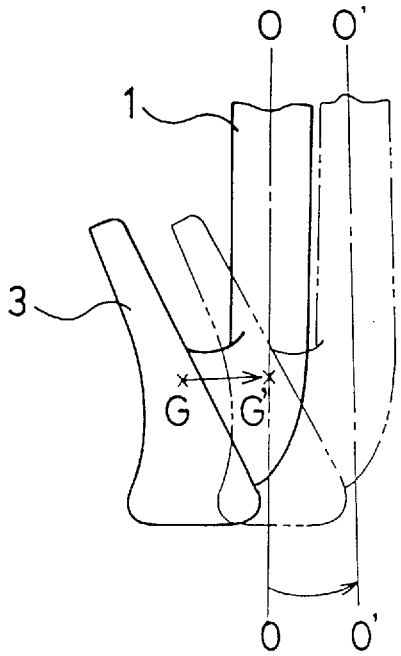
FIG. 17 is an explanatory view useful for explaining the operation of the present invention.

In other words, when the golf club is swung, the center of gravity G of the club head 3 starts a movement in such a manner as to move to the position G' which coincides with the center axis O—O while causing deflection of the club shaft 1 due to the centrifugal force as shown in FIG. 17. The momentum at this time is added to the momentum at the time of swinging of the golf club and affects the flying distance of the ball. Since this added momentum is proportional to the centroid distance, the present inventor has found out that if this centroid distance L is not uniform among the iron type golf clubs including the Nos. 3 to 9 irons, the difference of the flying distances between successively numbered clubs cannot be made substantially constant even though each golf club is swung with the same swing force.

Figure 16:
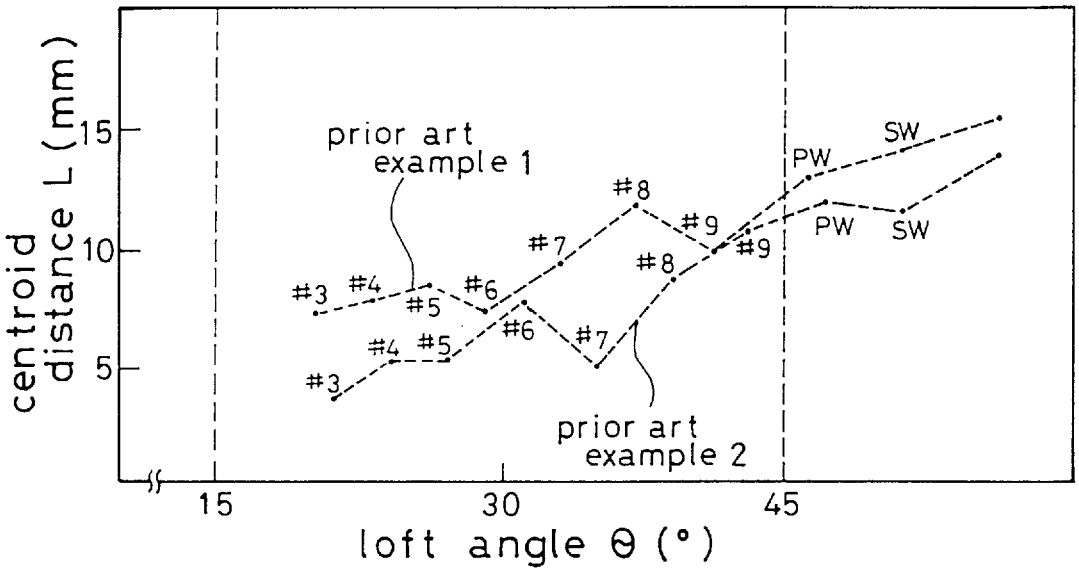
FIG.16 Prior Art
FIG. 16 is a graph showing the each relation between the centroid distance L and the loft angle θ in two iron type golf club sets according to the prior art.

When the relation between the loft angle and the centroid distance L is examined for a series of Nos. 3 larger left angle iron golf club heads according to the prior art, the centroid distance L exhibits a great variance as shown in FIG. 16.

In contrast, the present invention sets the centroid distance L in association with the loft angle θ within a predetermined range defined by the narrow range between linear plots of centroid distance and loft angle represented by the two expressions, i.e. $a\theta+b$ and $a\theta+b+1$, as shown in FIGS. 3 and 4 wherein the abscissa represents the loft angle θ and the ordinate represents the centroid distance L, on the basis of the finding described above. According to this structure, the difference of the flying distance between each of the numbered clubs can be made substantially constant within the range of 8 to 11 m when golfers of the ordinary skill swing the respective clubs at an ordinary head speed of a driver within the range of 35 to 45 m/sec.

This distance of 8 to 11 m is a desirable distance from the stand point of golf course stratesy for golfers having an ordinary head speed. If the difference in flying distance between each of the numbered clubs is less than 8 m, the significance of each of club numbers of the iron type golf clubs in a set of golf clubs containing Nos. 3 to 9 is reduced, and if it exceeds 11 m, on the other hand, adjustment of the distance to get a proper distance on the golf course becomes difficult.

When the inclination a is smaller than −0.2, the difference of the flying distance between one-number different clubs becomes less than 8 m. When it is greater than 0.3, on the contrary, the difference of the flying distance between one-number different clubs exceeds 11 m.

When the centroid distance L exceeds the range between one of the expressions $a\theta+b$ and $a\theta+b+1$, the difference of the flying distance between each of the numbered clubs cannot be made substantially constant within the range of between 8 and 11 m.

The centroid distance L described above can be set to a range of −10 mm to 30 mm to produce substantially different configuration golf club heads. It is preferable that the range of the centroid distance L is from 5 mm to 25 mm to produce golf club heads of practical use to hit easily. In the two formulas described above, the intercept b can be set arbitrarily as long as the centroid distance L has the range described above.

Figure 5:
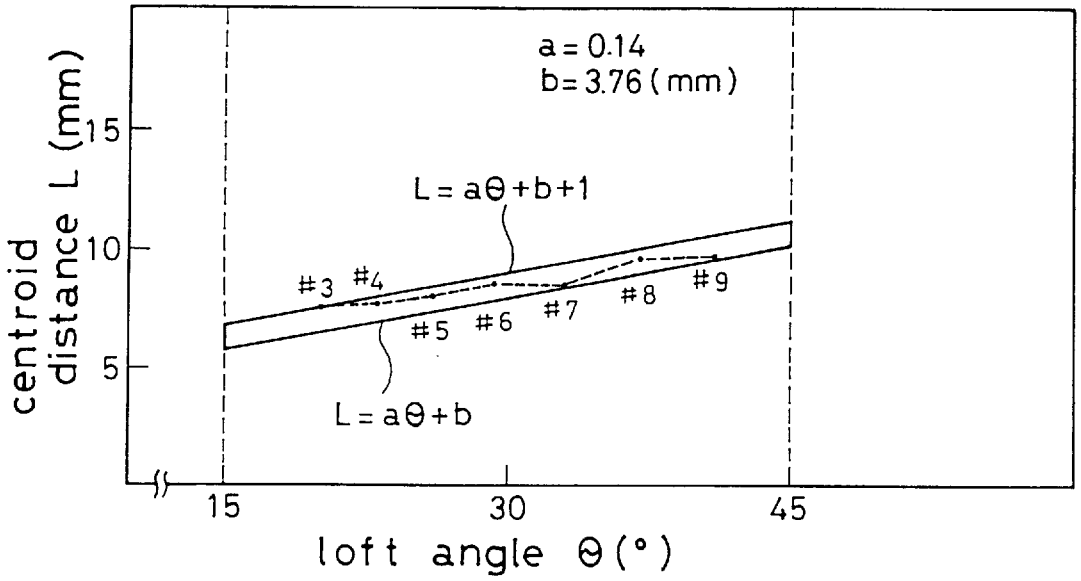
FIG. 5 is a graph showing the relation between the centroid distance L and the loft angle θ in a more desirable example than in the golf club set shown in FIG. 3.
Figure 6:
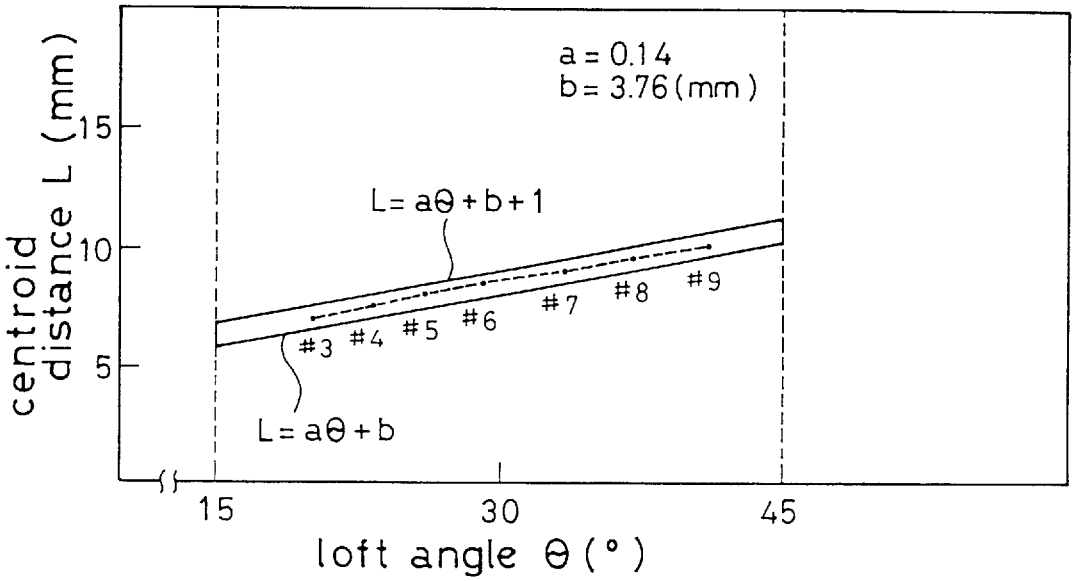
FIG. 6 is a graph showing the relation between the centroid distance L and the loft angle θ in a further desirable example than in the golf club set shown in FIG. 3.

When the centroid distance L falls within the range of $a\theta+b \leqq L \leqq a\theta+b+1$ in the present invention as shown in FIGS. 3 and 4, the slope a can be set at random. When $a>0$, the centroid distance L of a given club is preferably set to be greater than the centroid distance L of a club having the next lower club number with reduced loft angle θ as shown in FIG. 5. More preferably, the centroid distance L is increased and is allowed to approach linearity with a greater loft angle as shown in FIG. 6.

Figure 7:
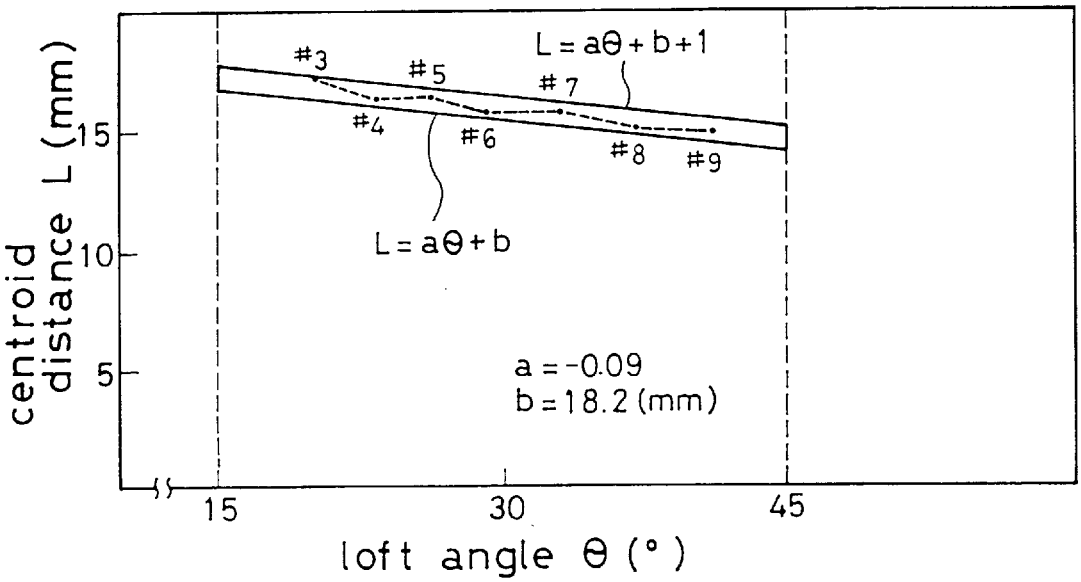
FIG. 7 is a graph showing the relation between the centroid distance L and the loft angle θ in a more desirable example than in the golf club set shown in FIG. 4.
Figure 8:
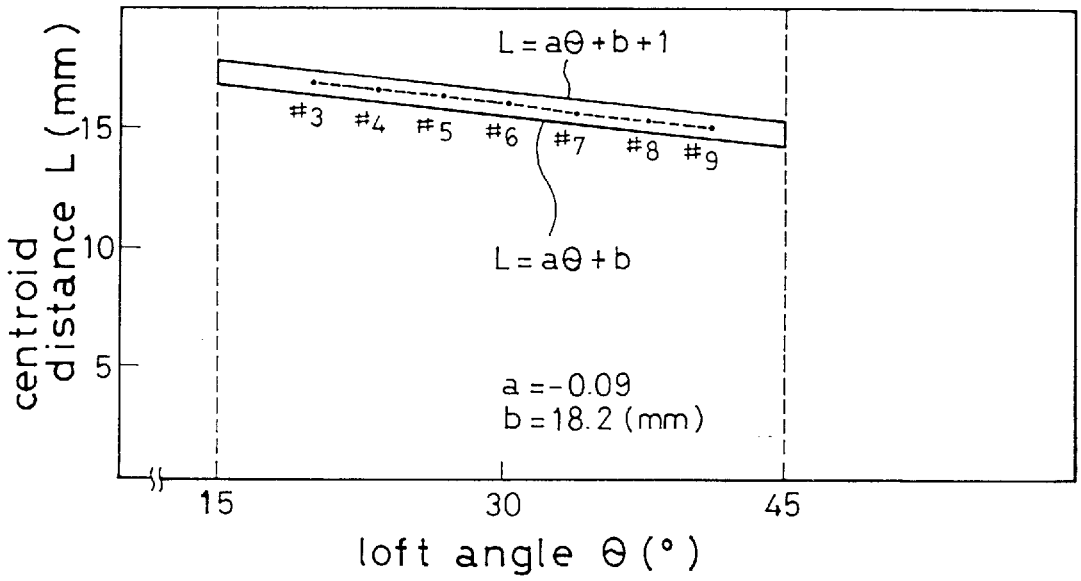
FIG. 8 is a graph showing the relation between the centroid distance L and the loft angle θ in a further desirable example than in the golf club set shown in FIG. 4.

The above explanation also holds true of the case of a<0. It is preferred to set the centroid distance L of a given club to be smaller than the centroid distance L of a club having the next lower club number with a smaller loft angle as shown in FIG. 7, and more preferably, the centroid distance L is gradually decreased with an increasing loft angle as shown in FIG. 8.

Figure 9:
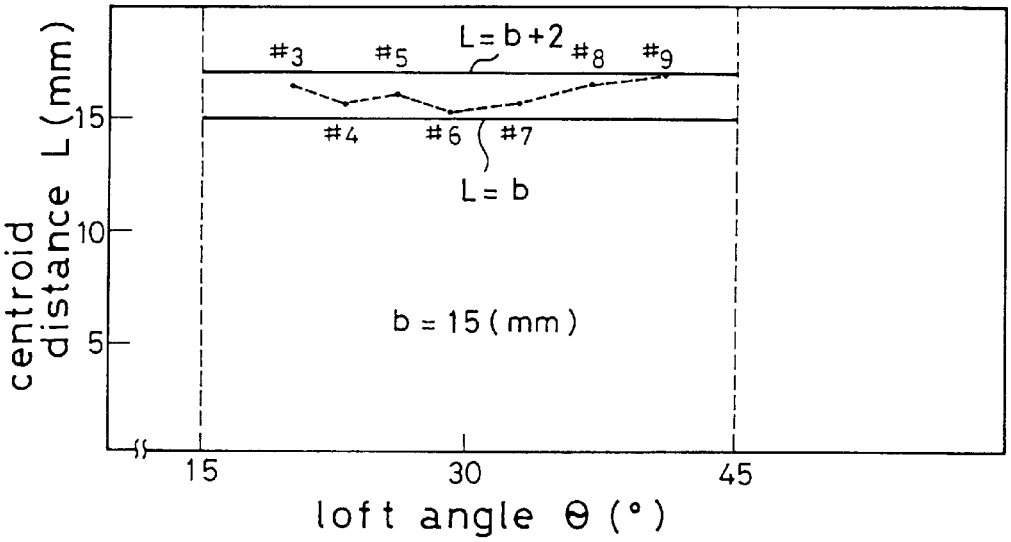
FIG. 9 is a graph showing the relation between the centroid distance L and the loft angle θ in still another example in the golf club set according to the present invention.

When a=0, the centroid distance L can be set to a value within the range of $b \leqq L \leqq b+2$ irrespective of the loft angle θ as shown in FIG. 9. In addition to the similar effect described above, by keeping the centroid distance within a range of the same level, ordinary swing can be made with the same feeling throughout the iron golf clubs of Nos. 3 to 9. In other words, in the conventional iron type golf clubs, there is the tendency that the centroid distance L increases at a large step with an increasing loft angle as shown in FIG. 16. Therefore, the centroid distance L is set to a small value for golfers hitting at a high head speed, to a value within the range of 11 mm to 15 mm for golfers at a mean head speed and to a value within the range of over 15 mm to 20 mm for beginners who have slower head speed than the golfers at a mean head speed and those who want to more easily loft a golf ball by a golf club having a lower club member. In this way, the golfers can ordinarily swing the iron type golf clubs throughout Nos. 3 to 9 with the same feeling.

In the formula $b \leqq L$ $b \leqq b+2$, the value b can be set to a range of −10 mm to 28 mm. It is preferably set to a range of 5 mm to 23 mm to produce practical golf clubs to hit easily.

Figure 10:
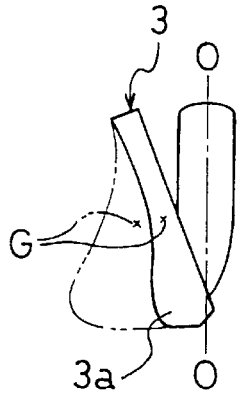
FIGS. 10(*a*) and 10(*b*) are side views of a club head exemplarily showing means for moving the position of the center of gravity of a club head with respect to the center axis of a club shaft.
Figure 10:
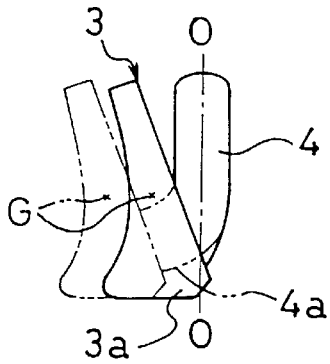

In the embodiment described above, the centroid distance L of the iron type golf club head can be changed, for example, by changing the thickness of the head main body 3*a* of the club head 3 in the longitudinal direction as indicated by a solid line or a two-dot-chain line as shown in FIG. 10(*a*). Alternatively, the centroid distance L can be adjusted by elongating the fitting portion 4*a* of the hosel 4 protruding upward with respect to the head main body 3*a* as indicated by a two-dot-chain line in the longitudinal direction or shortening it as indicated by a solid line in FIG. 10(*b*).

Figure 11:
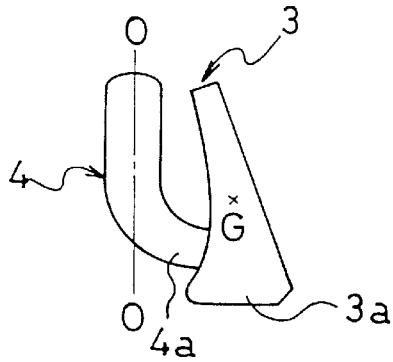
FIGS. 11(*a*) and 11(*b*) are side views showing an example of a club head in which the position of the center of gravity exists ahead of the center axis of the club shaft.
Figure 11:
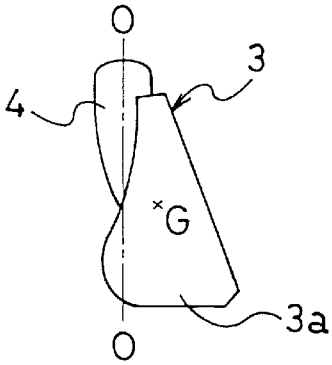
Figure 12:
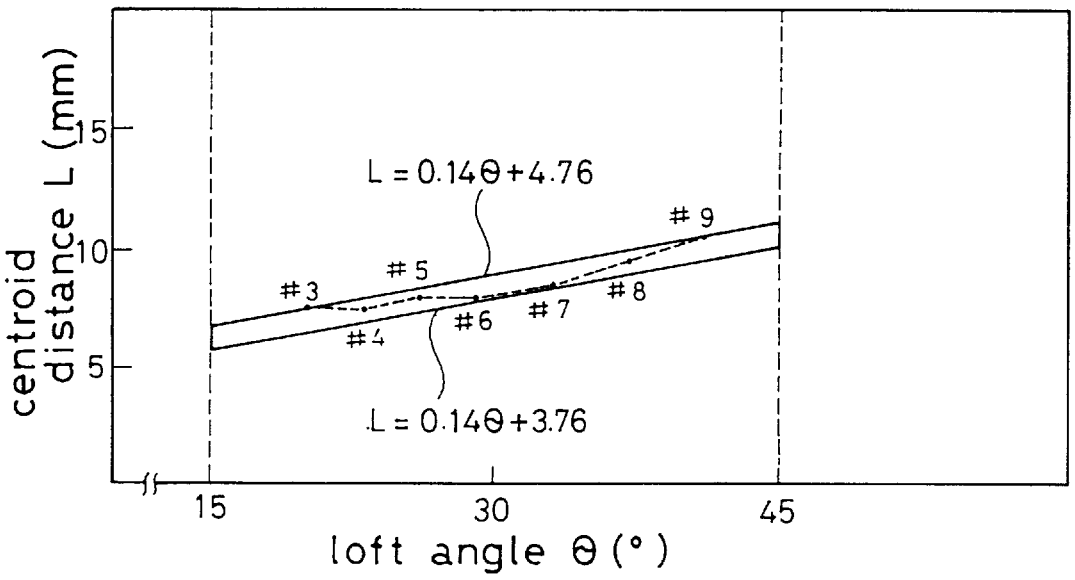
FIG. 12 is a graph showing the relation between the centroid distance L and the loft angle θ obtained by plotting data of Example 1.
Figure 13:
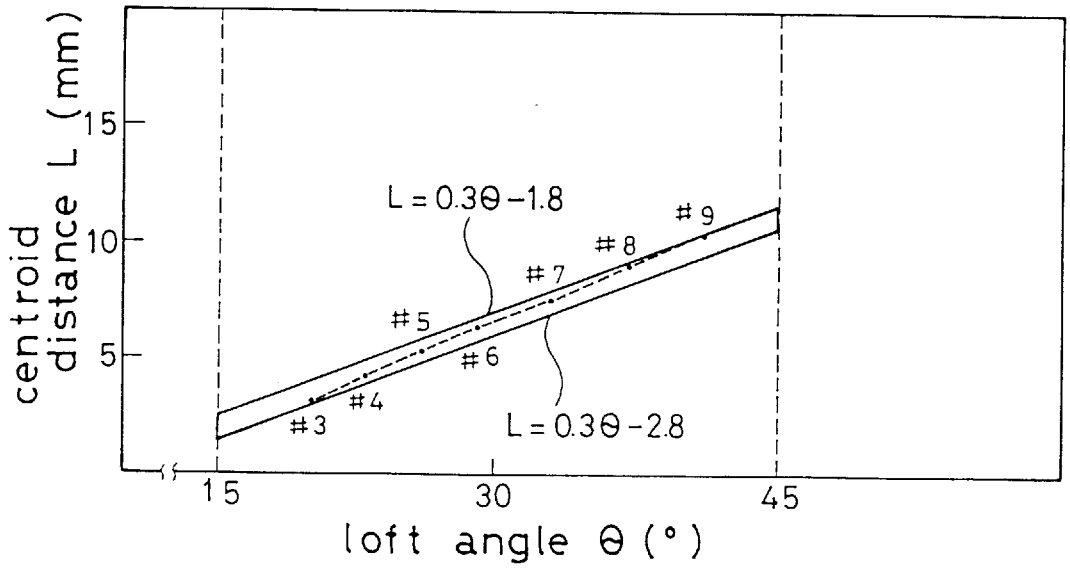
FIG. 13 is a graph showing the relation between the centroid distance L and the loft angle θ obtained by plotting data of Example 2.

FIGS. 11(*a*) and 11(*b*) show an iron type golf club head wherein its center of gravity G is positioned ahead of the center axis O—O of the club shaft. FIG. 11(*a*) shows the structure wherein the fitting portion 4*a* of the planted hosel 4 to the head main body 3*a* is elongated forward so as to position the center of gravity G ahead of the center axis O—O of the club shaft. FIG. 11(*b*) shows the structure wherein the hosel 4 is allowed to protrude toward the back side of the head main body 3*a* and the thickness of the head main body 3*a* is increased. As described above, the present invention can be suitably adapted for the club head the center of gravity G of which is positioned at the back side of the center axis O—O of the club shaft and for the club head the center of gravity G of which is positioned in the front side of the center axis, so long as they satisfy the formula described above.

The golf club set according to the present invention may be those club sets which include at least Nos. 3 to 9 iron type golf clubs. Wood type golf clubs to be combined with these iron type golf clubs are not particularly limited, and they may be of heretofore known types. When the centroid distance L of each club head in a series of the Nos. 3 to 9 iron type golf club heads falls within the range of $b \leqq L \leqq b+2$, it is advisable to unify the centroid distance in the heads of the wood type golf clubs, too, within the same range. In this way, continuity can be established between the wood type golf clubs and the iron type golf clubs for which feeling at the time of hitting of the ball has been likely to become discontinuous in the past.

Known pitching wedge and sand wedge can also be used for the golf club set according to the present invention.

Example 1:

Iron type golf clubs of Nos 3 to 9, each having a loft angle e and a centroid distance L tabulated in Table 1 and satisfying the formula (1) where a=0.14 and b=3.76, were produced.

When the evaluation test of the flying distance was conducted for each of these test golf clubs under the following measurement condition, the results tabulated in Table 1 could be obtained.

Evaluation Test of Flying Distance:

Each test golf club was fitted to a hitting robot, and was allowed to hit golf balls 10 times each with the head speed of a driver set to 40 m/sec. The mean distance was employed as the flying distance (m) of each test golf club.

TABLE 1

| club number (#) | #3 | #4 | #5 | #6 | #7 | #8 | #9 |
|---|---|---|---|---|---|---|---|
| loft angle θ (°) | 20 | 23 | 26 | 29 | 33 | 37 | 41 |
| centroid distance L (mm) | 7.5 | 7.5 | 8.0 | 8.0 | 8.5 | 9.5 | 10.5 |
| flying distance (m) | 160 | 151 | 141 | 130 | 120 | 111 | 101 |
| difference of flying distance from preceding club number (mm) | — | 9 | 10 | 11 | 10 | 9 | 10 |

It could be understood from Table 1 that the difference of the flying distance between one-number different clubs was from 9 to 11 m.

When the relation between the loft angle and the centroid distance in Table 1 was graphically represented by plotting the loft angle e on the abscissa and the centroid distance L on the ordinate and drawing two upper and lower, parallel straight lines capable of interposing the plotted points with the smallest vertical width, the centroid distance L was $0.14\theta+3.76 \leqq L \leqq 0.14\theta+4.76$.

Example 2:

Iron type golf clubs of Nos. 3 to 9, each having a loft angle θ and a centroid distance L tabulated in Table 2, were produced.

The evaluation test of the flying distance was conducted for each of these test golf clubs under the measurement conditions described above, and the results tabulated in Table 2 could be obtained.

TABLE 2

| club number (#) | #3 | #4 | #5 | #6 | #7 | #8 | #9 |
|---|---|---|---|---|---|---|---|
| loft angle θ (°) | 20 | 23 | 26 | 29 | 33 | 37 | 41 |
| centroid distance L (mm) | 3.2 | 4.3 | 5.4 | 6.4 | 7.7 | 9.1 | 10.5 |
| flying distance (m) | 167 | 156 | 145 | 134 | 123 | 112 | 101 |
| difference of flying distance from preceding club number (mm) | — | 11 | 11 | 11 | 11 | 11 | 11 |

It could be understood from Table 2 that the difference of the flying distance between one-number different clubs was 11 m.

When the relation between the loft angle and the centroid distance in Table 2 was graphically represented by plotting the loft angle θ on the abscissa and the centroid distance L on the ordinate and drawing two upper and lower, parallel straight lines capable of interposing the plotted points with the smallest vertical width, the centroid distance L was $0.3\theta-2.8 \leqq L \leqq 0.3\theta-1.8$.

Example 3:

Iron type golf clubs of Nos. 3 to 9, each having a loft angle θ and a centroid distance L tabulated in Table 3, were produced.

The evaluation test of the flying distance was conducted for each of these test golf clubs under the measurement conditions described above, and the results tabulated in Table 3 could be obtained.

TABLE 3

| club number (#) | #3 | #4 | #5 | #6 | #7 | #8 | #9 |
|---|---|---|---|---|---|---|---|
| loft angle θ (°) | 20 | 23 | 26 | 29. | 33 | 37 | 41 |
| centroid distance L (mm) | 15.7 | 14.9 | 14.1 | 13.4 | 12.4 | 11.5 | 10.5 |
| flying distance (m) | 149 | 141 | 133 | 125 | 117 | 109 | 101 |
| difference of flying distance from preceding club number (mm) | — | 8 | 8 | 8 | 8 | 8 | 8 |

It could be understood from Table 3 that the difference of the flying distance between one-number different irons was 8 m.

Figure 14:
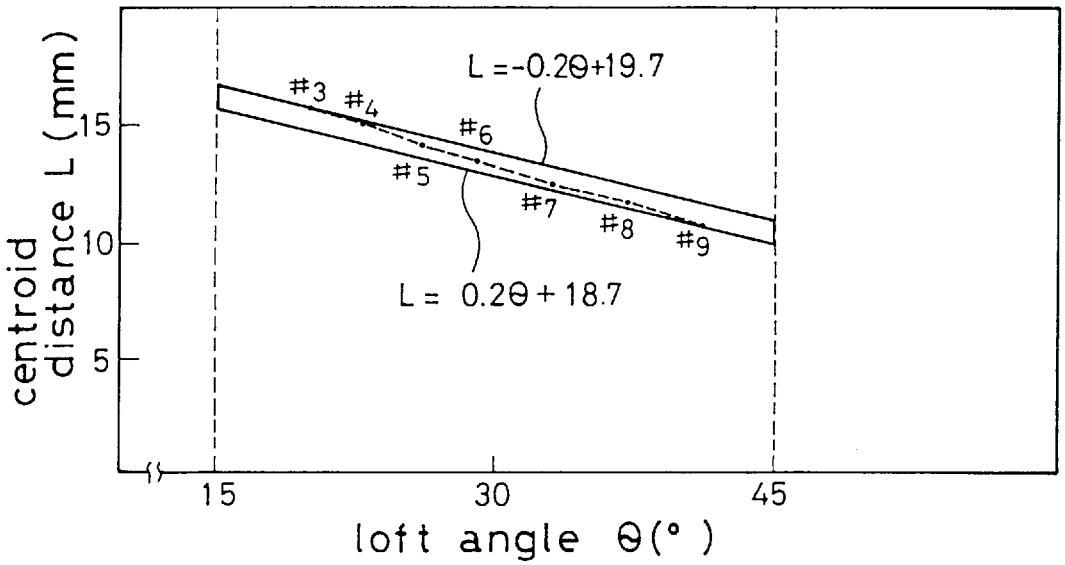
FIG. 14 is a graph showing the relation between the centroid distance L and the loft angle θ obtained by plotting data of Example 3.

When the relation between the loft angle and the centroid distance in Table 3 was graphically represented as shown in FIG. 14 by plotting the loft angle θ on the abscissa and the centroid distance L on the ordinate and drawing two upper and lower, parallel straight lines capable of interposing the plotted points with the smallest vertical width, the centroid distance L was $-0.2\theta+18.7 \leqq L \leqq -0.2\theta+19.7$.

Example 4:

Iron type golf clubs of Nos. 3 to 9, each having a loft angle θ and a centroid distance L tabulated in Table 4, were produced.

The evaluation test of the flying distance was conducted for each of these test golf clubs under the measurement conditions described above, and the results tabulated in Table 4 could be obtained.

TABLE 4

| club number (#) | #3 | #4 | #5 | #6 | #7 | #8 | #9 |
|---|---|---|---|---|---|---|---|
| loft angle θ (°) | 20 | 23 | 26 | 29 | 33 | 37 | 41 |
| centroid distance L (mm) | 13.6 | 13.8 | 15.0 | 14.2 | 13.0 | 13.7 | 14.0 |
| flying distance (m) | 152 | 142 | 132 | 124 | 116 | 105 | 96 |
| difference of flying distance from preceding club number (mm) | — | 10 | 10 | 8 | 8 | i1 | 9 |

It could be understood from Table 4 that the difference of the flying distance between one-number different irons was 8 to 11 m.

Figure 15:
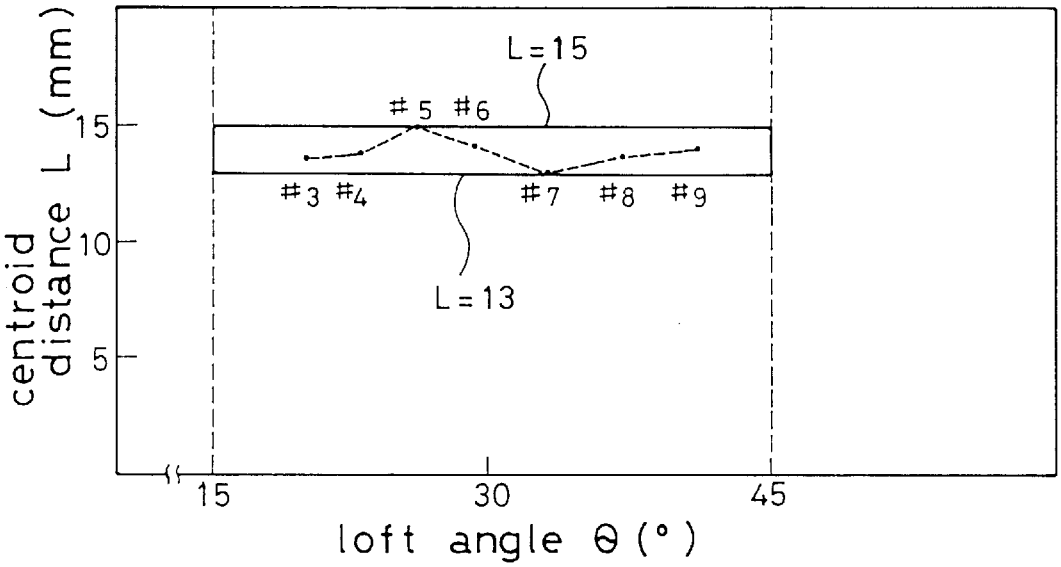
FIG. 15 is a graph showing the relation between the centroid distance L and the loft angle θ obtained by plotting data of Example 4.

When the relation between the loft angle and the centroid distance in Table 4 was graphically represented as shown in FIG. 15 by plotting the loft angle θ on the abscissa and the centroid distance L on the ordinate and drawing two upper and lower, parallel straight lines capable of interposing the plotted points with the smallest vertical width, the centroid distance L was $13 \leqq L \leqq 15$.

As described above , the present invention sets the centroid distance L (mm), which is the distance drawn from the center of gravity of the club head to the plane containing the central axis of the club shaft and which is orthogonal to another plane that is orthogonal to the club head face, as unifies it within a substantially predetermined range irrespective of the loft angle. Accordingly, in the golf club set comprising at least the iron type golf clubs of Nos. 3 to 9, the present invention makes it possible for a golfer to obtain a substantially constant difference of the flying distance between one-number difference clubs if the golfer swings each club at the same way.

What is claimed is:

1. A golf club set comprising:

at least seven golf club irons, each including a club head having a face and a shaft having a central axis;

the golf club irons having loft angles θ increasing progressively in successive increments from 15° to 45° and lengths decreasing progressively with increasing loft angle, and each of the club irons having a centroid distance L in millimeters between the center of gravity G of the respective club head and a plane containing the central axis of the respective shaft and orthogonal to another plane orthogonal to the respective club head face, the centroid distance L for all the golf club irons being in the range:

$$b \leqq L \leqq b+2$$

where b is a value in millimeters.

2. A golf club set according to claim 1, including at least one golf club wood having a centroid distance L.

3. A golf club set according to claim 1, wherein b is in a range of from −10 mm to 28 mm.

4. A golf club set according to claim 1, wherein b is in a range of from 5 mm to 23 mm.

* * * * *